US011370512B2

(12) United States Patent
Van Der Laan

(10) Patent No.: US 11,370,512 B2
(45) Date of Patent: Jun. 28, 2022

(54) TUG WITH AN ALL AROUND TOWING INSTALLATION

(71) Applicant: IMC CORPORATE LICENSING B.V., Ijssel (NL)

(72) Inventor: Markus Van Der Laan, Oegstgeest (NL)

(73) Assignee: IMC CORPORATE LICENSING B.V., Ijsselm (NL)

( * ) Notice: Subject to any disclaimer, the term of this patent is extended or adjusted under 35 U.S.C. 154(b) by 59 days.

(21) Appl. No.: 16/963,526

(22) PCT Filed: Jan. 23, 2019

(86) PCT No.: PCT/IB2019/050544
§ 371 (c)(1),
(2) Date: Jul. 21, 2020

(87) PCT Pub. No.: WO2019/145861
PCT Pub. Date: Aug. 1, 2019

(65) Prior Publication Data

US 2021/0047011 A1 Feb. 18, 2021

(30) Foreign Application Priority Data

Jan. 24, 2018 (MY) ..... 2018700310

(51) Int. Cl.
*B63B 35/68* (2006.01)
*B63B 21/58* (2006.01)

(52) U.S. Cl.
CPC ..... *B63B 35/68* (2013.01); *B63B 21/58* (2013.01)

(58) Field of Classification Search
CPC ..... B63B 21/00; B63B 21/04; B63B 21/56; B63B 21/58; B63B 35/66; B63B 35/68
USPC ..... 114/242, 249, 253
See application file for complete search history.

(56) References Cited

U.S. PATENT DOCUMENTS

| | | | | |
|---|---|---|---|---|
| 5,575,230 | A | 11/1996 | Eronen | |
| 10,836,617 | B2 * | 11/2020 | Holmberg | B63B 35/68 |
| 2006/0102060 | A1 | 5/2006 | Vila Boixadera et al. | |

FOREIGN PATENT DOCUMENTS

| | | | |
|---|---|---|---|
| NL | 1012591 | C2 | 1/2001 |
| WO | 2016204726 | A1 | 12/2016 |

* cited by examiner

*Primary Examiner* — Daniel V Venne
(74) *Attorney, Agent, or Firm* — Renner, Kenner, Grieve, Bobak, Taylor & Weber

(57) ABSTRACT

A tug (11) comprising a deck having an aft deck (16), a central deck (12) and a forward deck (15) and a rotatable towing installation (13) disposed on the central deck. The towing installation and central deck are sloping upwards from the aft deck to the forward deck with respect to a horizontal plane. The upward sloping angle (α) of the towing installation is at least 5 degrees. The design provides free towing all around in the horizontal plane in combination with sufficient bow height and buoyancy and in addition below deck space for e.g. additional accommodation.

20 Claims, 5 Drawing Sheets

TUG WITH AN ALL AROUND TOWING INSTALLATION

FIELD OF INVENTION

The invention relates to a tug. More specifically, the invention concerns a tug having an all around towing system.

BACKGROUND OF THE INVENTION

In harbors and restricted sailing areas, ships are usually assisted by one or more tugs. The ship and tug are connected by a towline and the tug maneuvers in the required position to pull the ship. In addition to towing, the tug can also perform pushing operations.

Tugs in general have a fixed towing hook or towing winch on deck and the towline is connected to this equipment. Further an accommodation and wheelhouse are mounted on deck, thereby hindering the towline to rotate freely around.

A solution to enable free rotating all around in the horizontal plane is offered by various rotating towing installations. Examples include DE881312 (Schlepper für Schiffe by Buff 1951), NL1012977 (Ontwerp van sleepboot by M. van der Laan 1999) and NL1027414 (Sleepboot met verplaatsbare sleepinstallatie by Mampaeij 2006). These patents describe a 360° rotatable towing installation on either a circular track or an oval track, running on the outer side of the accommodation/wheelhouse. Typical diameter or width of the towing installation is in the range of 66%-100% of the tug's width. By moving the towing point to the ship's side, the heeling moment is reduced and capsizing risk minimized.

The tug designs all have a horizontal deck surface whereon the towing installation is fitted. In addition, the installation is positioned at a relatively low height to reduce the capsizing moment whilst towing sideward. To establish a straight line from the towing installation to the towed vessel, the bow and stern area must remain low, a typical sloping upward angle of 10° may be considered. The result hereof is a tug with a relative low freeboard beneath the towing installation and a relatively small volume in the bow area below the main deck. For harbor tugs operating in calm water and limited crew members (day operation), these design limitations by rotating towing installations are acceptable, but set clear limitations for operations at sea and longer voyages with 24 hr crew.

Therefore, these towing arrangements mounted in a horizontal plane cannot be combined with important tug design requirements for sea operations and longer voyages like e.g. minimum bow height, sufficient buoyancy volume in bow area and in addition sufficient below deck space for e.g. accommodation.

The object of the present invention is to provide an improved tug design which does not have the drawbacks described above, i.e. to have sufficient bow height, sufficient volume in the bow area for buoyancy and sufficient below deck space.

SUMMARY OF THE INVENTION

In one aspect, the invention provides a tug comprising:

a deck having an aft deck, a central deck and a forward deck; and a rotatable towing installation disposed on the central deck;

wherein the towing installation and central deck slope upwards from the aft deck to the forward deck with respect to a horizontal plane;

wherein the upward sloping angle of the towing installation is at least 5 degrees.

This object is achieved by arranging the towing installation at an upward sloping angle from the aft deck to the forward deck. The central deck level below the towing installation shall preferably be arranged at a parallel angle to the towing installation or may consist of a number of horizontal and straight or curved sloping parts upward from the aft deck to the forward deck. At the forward position, the towing installation has a higher position enabling to raise the bow deck upward and thereby creating a higher bow height, more buoyancy volume in the bow area and sufficient below deck space for e.g. accommodation. Towing installations may comprise all kind of designs which are known in prior art and include both circular, oval and other shapes. Forward of the towing installation, the deck height may slope upward at typical 10° to enable a straight line of the towing installation to the assisted ship. At the aft position, the towing installation has a lower position enabling to lower the aft deck. Towing operations can be performed from the rotating towing installation, but can also be performed from a second fixed towing installation on the aft deck at low height. The first rotatable towing point can preferably be used for ship assistances in port area and the second fixed towing point can be used for conventional towing operations, including longer voyages outside port areas. The sloping angle of the towing installation from the aft deck to the forward deck shall be at least 5 degrees and preferably in the range of 6-12 degrees in upward direction. Tugs with conventional shaft propulsion have a clear definition of bow and stern as the propellers are located aft and the bow on the opposite side. However, for all kind of new tug designs with various hull shapes and propulsor types and positions, bow and stern definitions may not be clear and therefore bow should be considered as the higher end of the tug and stern as the lower end of the tug.

According to another advantageous design, the described sloping angle of the towing installation starts at the aft end of the rotating towing installation and ends at the forward end of the towing installation, thereby creating a horizontal higher forward deck area and a horizontal lower aft deck area. The horizontal area enables safe crew operations on deck and useful space with constant height below the main deck for crew and installations.

According to another advantageous design, the deck below the towing installation slopes upward according to the described angle and both forward and aft decks have a slope angle. The aft deck slopes down in forward direction and the forward deck slopes upward in forward direction. Typical angle for aft deck downward is in range of 4-8 degrees and forward deck upward in range of 5-10 degrees. The sloping angle of the towing installation may corresponds to approximate the height of one accommodation layer, e.g. a human length plus height of supporting structures. Hereby the crew can enter the accommodation at the aft end above the towing installation and at the forward end proceed to the internal accommodation/spaces below the towing installation.

According to another advantageous design, the towing installation consists of a circular towing installation in the sloping plane and a circular vertically extending pipe structure below the towing installation. As a result of the sloping angle, the vertically extending circular pipe does not (fully) correspond to the circular towing installation. In order to bridge these small misalignments, a single heavy thick plate is welded on top of the circular supporting pipe structure. The thickness of this heavy thick plate depends on the size of the tug and the pull forces, typical sizes are 80-100 mm for smaller sized tugs with dynamic pull forces of 500-600 kN, up to 200 mm for large sea going tugs. The diameter/width of the heavy thick plate shall be in the range of 66%-100% of the tug's beam. The supporting steel structure below deck level can maintain a fully vertically extending structure in either transverse and/or longitudinal direction. On the inner side of the pipe additional stiffening and plating can be fitted for support of the heavy thick plate or curved or multi-chine vertical pipe. This aligns with standard building practices in ship yards and facilitates ease of building and cost reduction.

According to another advantageous design, the towing installation consists of a circular towing installation in the sloping plane and a vertically extending curved or multi-chine pipe structure below the towing installation. As in previous design, the curved or multi-chine pipe structure does not (fully) correspond to the circular towing installation. In order to bridge these small misalignments, a single heavy thick plate is welded on top of the supporting pipe structure. Again, the supporting structure below deck level can maintain a fully vertical extending structure in either transverse and/or longitudinal direction. The multi-chines can be advantageously aligned with the transverse and/or longitudinal plate and stiffener structures. The outer edges of the outer pipe are at least 85% preferably 90% of the radius of the heavy plate.

According to another advantageous design, inside the vertical curved or multi-chine pipe structure, a smaller multi-chine pipe can be used with plating parallel to the outer multi chine pipe. The multi-chine pipe can for example use 8 chines for inner and outer pipe but also higher numbers like 12 or 16 can be used. Further also a combination of different chine numbers can be used, in general the outer pipe needs to align with the outer curvature of the towing installation and needs more chines than the inner pipe. For example, a 12 or 16 chine outer pipe can be combined with a 8 or 12 inner pipe. Also, a combination of multiple chines and part curvature can be used for either the outer and/or the inner pipe.

According to another advantageous design, the accommodation shape above the towing installation aligns with the outer pipe chines and uses the same number of chines to obtain an aligned structure in vertical direction. Although more space inside the accommodation is in general advantageous, the accommodation outer shape can also align with the inner pipe chines. And for specific design cases also a partial support from the outer and inner pipe can be used.

According to another advantageous design, the towing installation consists of a non-circular towing installation in the sloping plane and e.g. oval or elliptical shapes can be used. The single heavy plate follows the same outer shape of the towing installation. Again, the vertically extending pipe structure below the single heavy plate installation can approximately match the shape of the towing installation and the application of a single heavy thick plate can again bridge small misalignments along the curvature.

According to another advantageous design, the towing installation can be welded to the single heavy thick plate in any suitable way.

According to another advantageous design, the towing installation can be mounted to the single heavy thick plate with any suitable means e.g. by using heavy bolts for compression and/or connecting plates with mounting edges to take the shear force. Mounting the towing ring offers additional operational advantages for (dis)mounting, repairs, replacements and maintenance. Mounting can be done on the upper side, the outer side or the lower side, or any advantageous combination. One example is a combination of mounting both on the upper side and the lower side and by forming an 'U'-shaped grabbing structure around the heavy thick plate.

According to another advantageous design, the towing installation can be mounted on rail (segments) which are mounted on the single heavy thick plate in machined grooves along the outer edge and connected by multiple bolts or equivalent connectors.

According to another advantageous design, the building process can be further facilitated by building the deck structure first without the single heavy top plate. The single heavy top plate can be separately built on a flat construction floor and composed of various plate segments to form the circular shape. Finally, the deck structure can be lifted by heavy cranes and lowered upside down on the heavy top plate. Welding between the upside-down deck structure and the heavy plate can be performed in an efficient way, since welding material is held in position by downward operating gravity force. All welding is performed in flat position (according to ASME 1F and 1G code for welding) and not in overhead position because welding in an overhead position (4F and 4G codes) increases risk for welding failures and is not ergonomic for human functioning. Once the top plate is welded all around to the supporting deck structure, the whole deck structure including the top plate can be lifted up by heavy cranes and turned upside down to mount on the other building blocks of the tug's hull. At the final stage, the accommodation, wheelhouse and funnels can be mounted on top of this single heavy thick plate.

BRIEF DESCRIPTION OF THE DRAWINGS

The present invention will become more clearly understood from the following description of the embodiments thereof, when taken in conjunction with the accompanying drawings. However, the embodiment and the drawings are given only for the purpose of illustration and explanation, and are not to be taken as limiting the scope of the present invention, the scope of which is to be determined by the set of appended claims.

DETAILED DESCRIPTION OF THE EMBODIMENT

Figure 1:
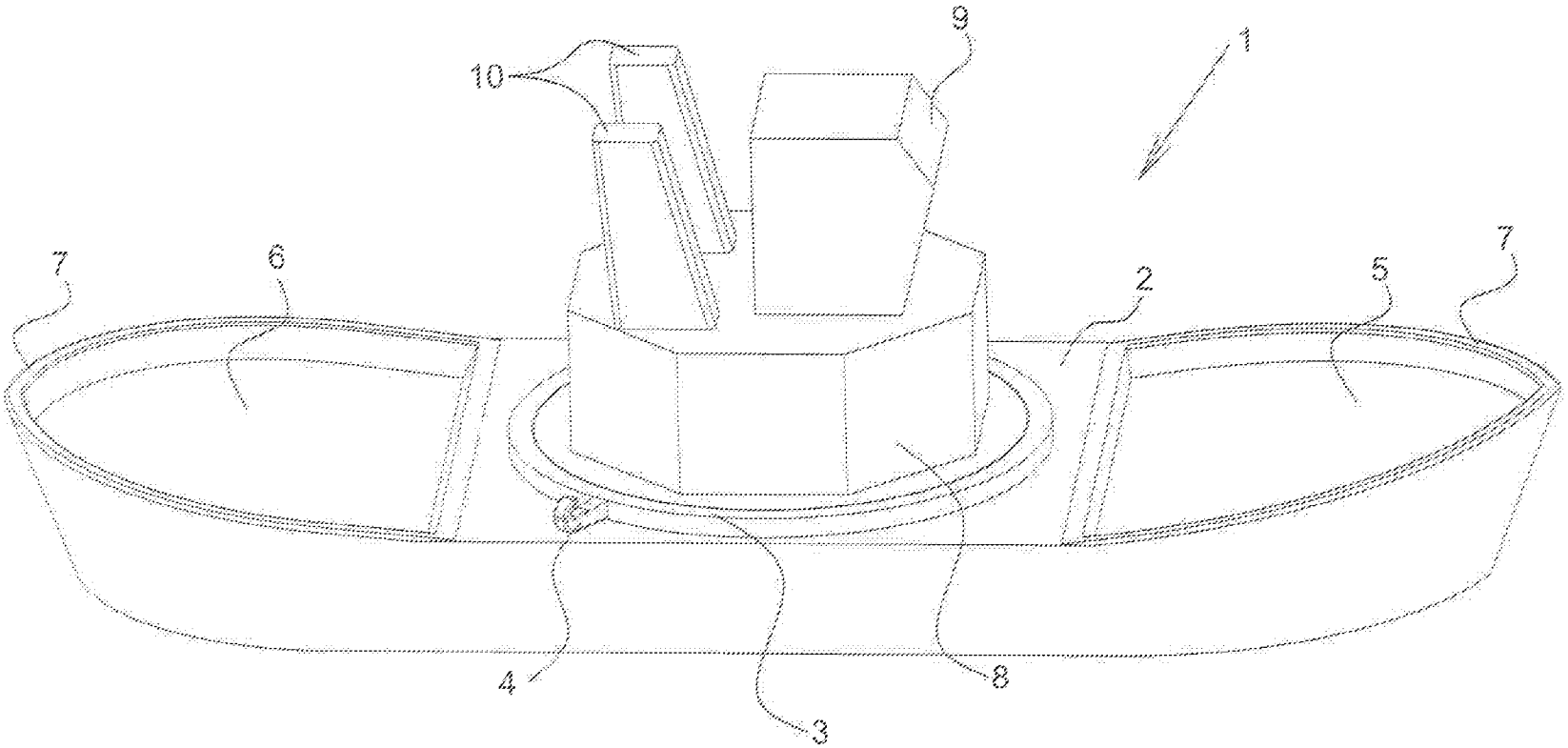
FIG. 1 shows a tug according to a prior art all around towing design in a perspective view above waterline.

The conventional tug 1 represented in FIG. 1 is provided with a central deck 2, a circular towing installation 3 and a towing hook 4. Further, the forward deck 5 and aft deck 6 are shown and at the outer edge fitted with a railing/bulwark 7. The circular towing installation 3, consisting of a fixed inner ring-shaped base and a rotating outer ring, and the central deck 2 are positioned horizontally and the forward and aft deck 5, 6 are sloping upward to both ends. The upward sloping angle of the forward deck 5 and parallel bulwark 7 is in the range of 5-10 degrees to allow the towline to pass unhindered to the vessel towed. The downward sloping angle of the aft deck 6 and parallel bulwark 7 are in the range of 5-7 degrees, again to allow the towline to pass unhindered to the vessel towed. In FIG. 1, the central deck 2 is elevated above the connection with the forward and aft deck 5, 6, the height corresponding to typical railing/bulwark height of 700-900 mm. Inside the towing ring is the accommodation 8 and on top of the accommodation 8, the wheelhouse 9 and funnels 10. The towing installation 3 can for example consist of a circular rotating ring extending all around the circular fixed structure by means of rollers or bearings. And the towing installation 3 can for example consist of an oval shaped rail system where the multiple carriages move. These multiple carriages only extend over a small part of the circumference (not shown).

Figure 2:
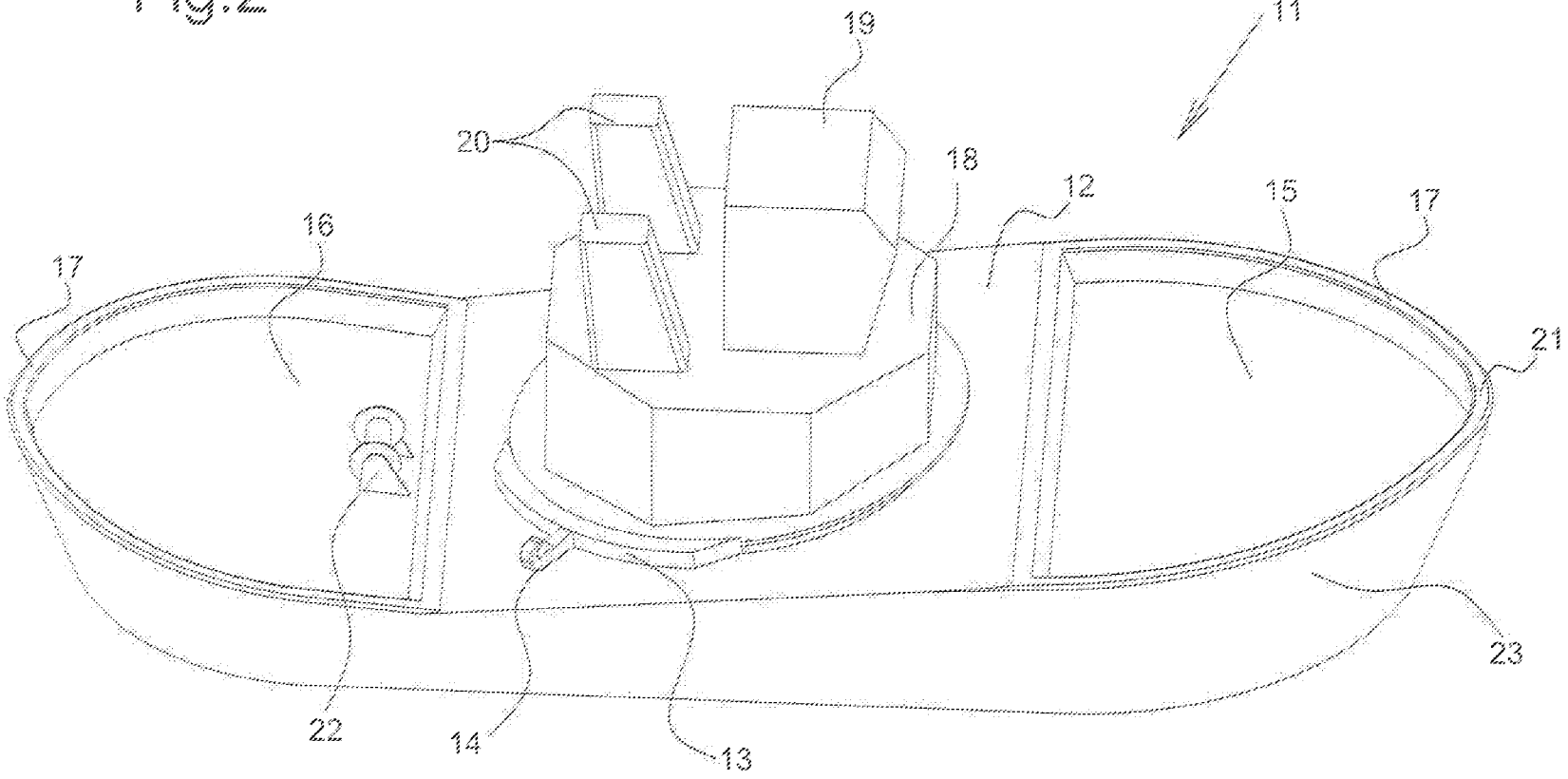
FIG. 2 shows a tug according an embodiment of the invention.

The tug 11 represented in FIG. 2 is according to an embodiment of the invention. It is provided with a central deck 12, a circular towing installation 13 and a towing hook 14. Further the forward deck 15 and aft deck 16 are shown, again along the outer edge fitted with a bulwark 17, the accommodation 18, wheelhouse 19 and funnels 20. The towing installation 13 includes a fixed inner ring-shaped base and a rotating outer ring, which is rotatable 360 degrees with respect to the tug 11 about the central deck 12. The towing installation 13 in another embodiment may have a fixed inner ring-shaped base and a rotating (outer) carriage, which is 360 degrees rotatable with respect to the tug 11 about the central deck 12. The carriage may have a length in the range of 5-25% of the circumference of the ring shaped base. The towing installation 13 and central deck 12 are oriented at an upward sloping angle in the longitudinal forward direction from aft deck 16 to forward deck 15. In this embodiment, the surface of the central deck 12 is oriented parallel to the upward slope of the towing installation 13. In another embodiment the surface to the central deck 12 is oriented not necessarily parallel to the upward slope of the towing installation 12. The forward deck 15 slopes upward in a longitudinal forward direction to create more bow height 21, more buoyancy in the bow area and sufficient space 23 below deck. The aft deck 16 slopes downward in a longitudinal forward direction to create a lower deck for typical towing operations. The connection to the towed vessel can be established with a tow hook 14 on the towing installation 13, but can also be established with a winch or other suitable connection system (not shown). Further on the aft deck 16 a fixed winch 22 is shown for conventional towing over the stern. This can also be a towing hook or any suitable connection (not shown).

Figure 3:
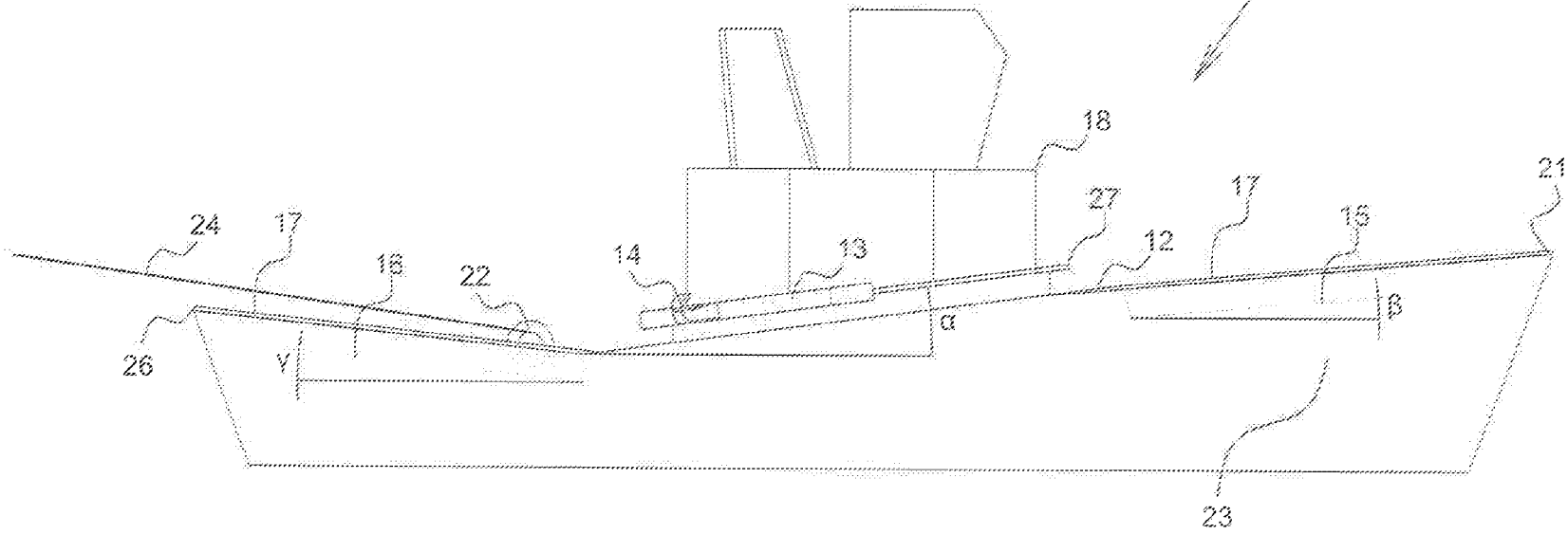
FIG. 3 shows the single heavy thick plate and supporting below pipe deck structure.

FIG. 3 represents a side view of the tug 11 according to the embodiment, with a towing installation 13, a tow hook 14, a central deck 12 and an increased bow height 21 and more volume in the bow area 23. Further there are three sloping angles: $\alpha$ for the angle between the horizontal line and the sloping angle of the towing installation 13, $\beta$ for the angle between the horizontal line and the sloping angle of the forward deck 15 and bulwark 17, and $\gamma$ for the angle between the horizontal line and the sloping angle of the aft deck 16 and bulwark 17. The towing installation 13 is mounted on the single heavy thick plate 27 and is positioned at the aft end above the height of the aft deck 16 plus bulwark 17 and at the forward end above the height of the forward deck 15 plus bulwark 17. For reasons of stability the towing installation 13 shall be close to the top of the bulwark 17. Height between towing installation 13 and bulwark 17 shall be e.g. in the range of 250-750 mm. The bulwark 17 on aft and forward deck 16, 15 enables safe crew operations. The central deck 12 has no bulwark along the outer sides and the crew is intended to move only near the centerline of the central deck 12 and not near the sides.

In another embodiment, the central deck 12 has the same height but along the sides the height is reduced over a width of e.g. 600-1000 mm and fitted with a bulwark 17. Hereby the crew can move safely along the sides of the central deck 12. This embodiment can be applied for larger sized (sea going) tugs. In another embodiment, the whole central deck 12 moves down with e.g. 700-900 mm and is fitted along the sides with a bulwark 17; the aft deck 16 aligns with the aft end of the central deck 12 and the forward deck 15 aligns with the forward end of the central deck 12.

In another embodiment, a railing is fitted inside the towing installation to enable the crew to move safely between the accommodation 18 and towing installation 13. Also various combinations with and without bulwark 17 are possible, depending on the intended purpose of the tug 11. On the aft deck 16 the optional secondary towing point 22, in this case shown as a winch and a towline 24 over the stern 26, which can be used for conventional towing.

The upward sloping angle $\alpha$ of the towing installation 13 is between 5 to 12 degrees. The forward deck 15 slopes upward with a sloping angle $\beta$ with respect to a horizontal plane in the range of 5 to 10 degrees. The aft deck 16 slopes downward with a sloping angle $\gamma$ with respect to a horizontal plane in the range of 4 to 8 degrees.

Figure 4:
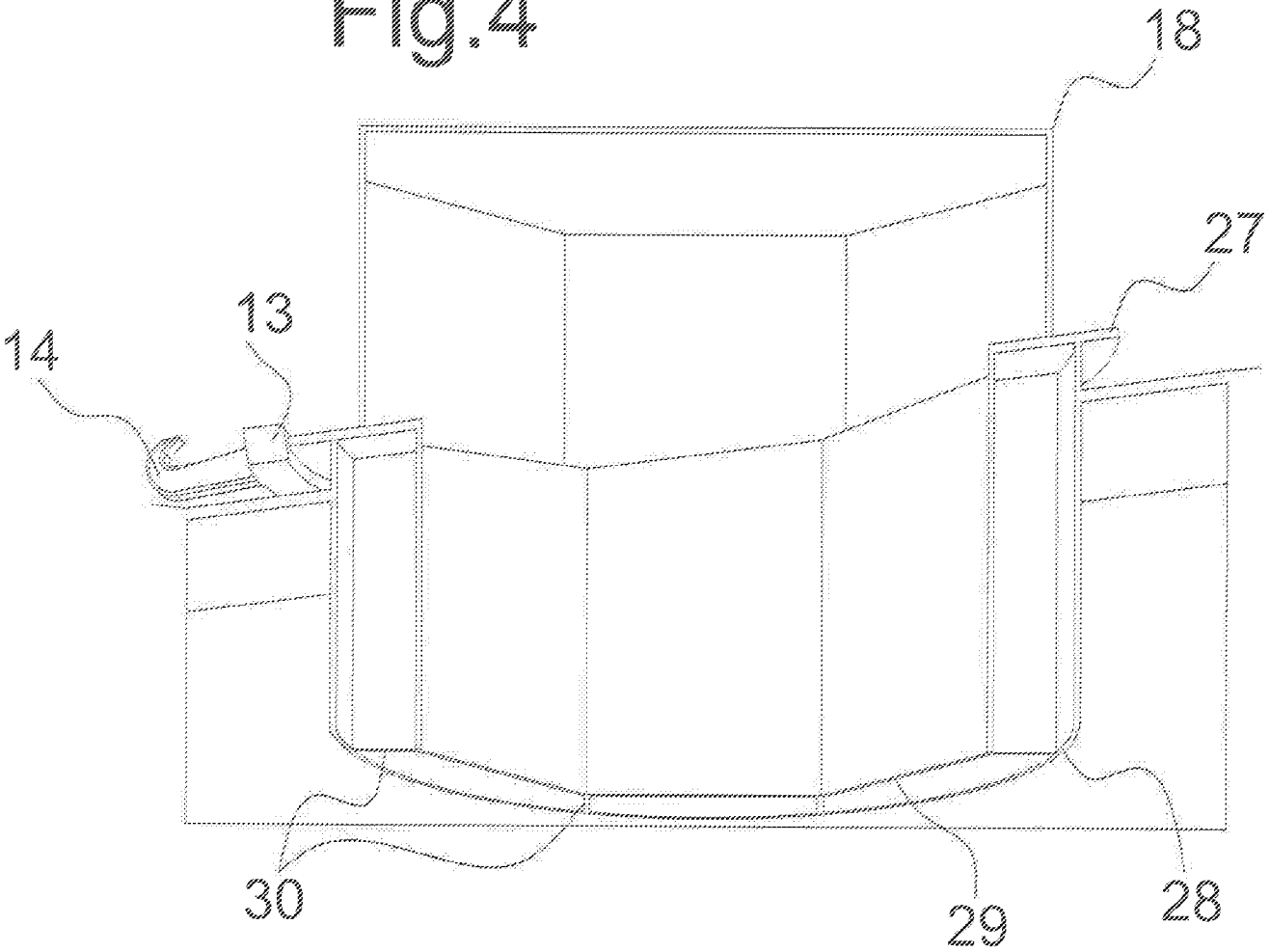
FIG. 4 shows various supporting vertical structures, circular outside, curved or multi-chined inside; and both inner and outer multi-chined.

FIG. 4 represents a cross section over the centre line to port side, with the towing installation 13 and the tow hook 14, the single heavy thick plate 27 welded on top of the vertical outer pipe structure 28 and the inner pipe structure 29 and the connecting plate structures 30 between the outer and inner pipes 28, 29. Only the main structural members are shown. Both supporting pipe structures 28 and 29 extend vertically and also the accommodation 18 outside structure. Likewise, the curved surfaces of the supporting pipe structures 28, 29 are also extended vertically.

Figure 5:
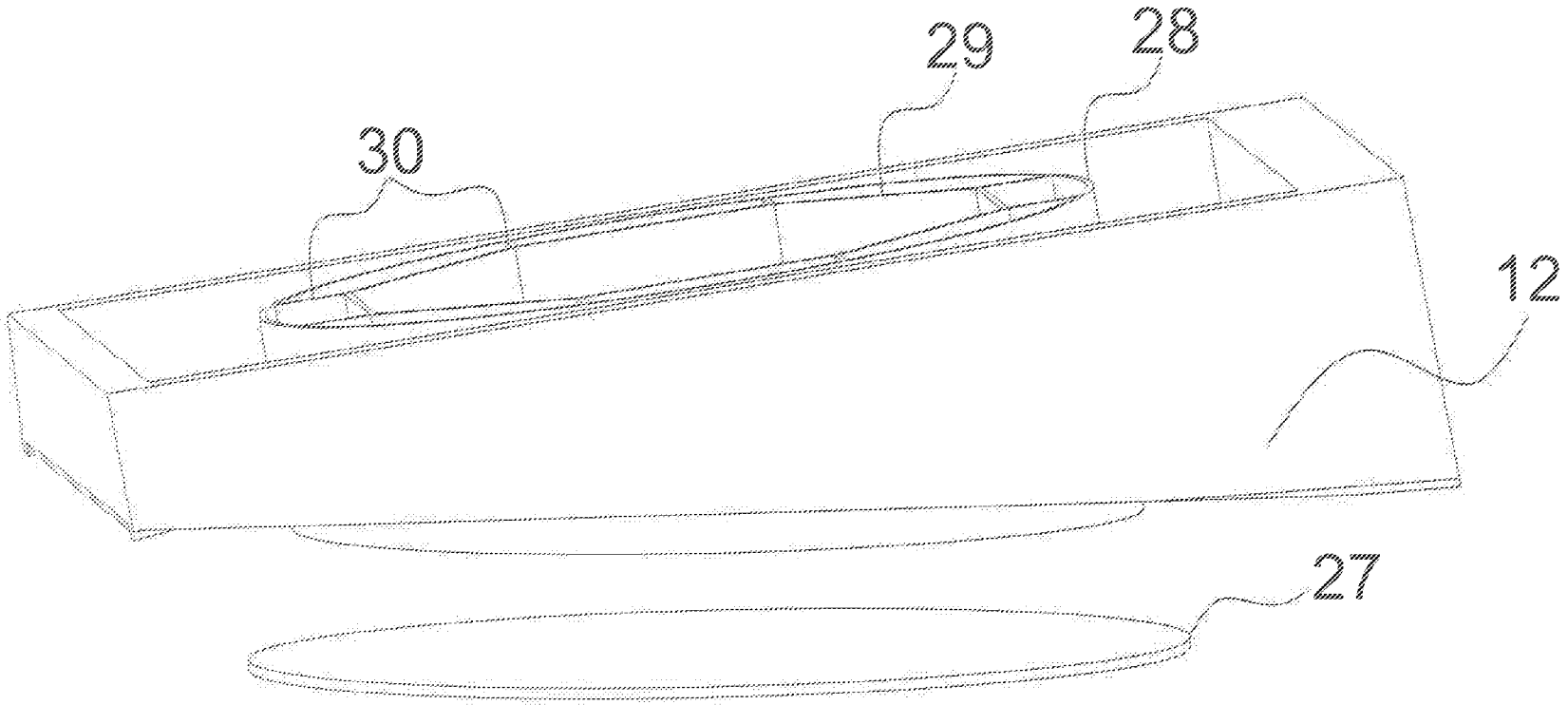
FIG. 5 shows the assembly procedure for welding a single heavy thick plate to the below deck structure.

FIG. 5 shows an advantageous assembly procedure of ship production. The single heavy thick plate 27 is first constructed on the work floor of the ship yard, next the central deck 12 is built with all supporting structural members and both outer 29 and inner 28 vertical support structures including connecting plate structures 30. This can be built in standard upright condition. For assembly the central deck 12 is lifted up, turned upside down and lowered on the heavy thick plate 27, followed by full welding of both components. Finally, the central deck 12 and welded heavy plate 27 are lifted up, turned back in upright position and mounted on the other building blocks of the tug 11. Before assembly, the heavy thick plate 27 can be machined on the work floor of the ship yard, this can include grooves along the outer edge on one side or on both sides.

Although the invention has been described above with reference to a preferred embodiment, numerous modifications may be made without departing from the scope of the present application. The all around towing installation may be constructed in all kind of different arrangements of bearings, rails and rollers both on fully circular shapes and on oval or non-circular shapes.

The invention claimed is:

1. A tug (11) comprising:

a deck having an aft deck (16), a central deck (12) and a forward deck (15); and a rotatable towing installation (13) disposed on the central deck;

characterized in that the towing installation and central deck slope upwards from the aft deck to the forward deck with respect to a horizontal plane;

and in that an upward sloping angle (a) of the towing installation is at least 5 degrees;

wherein the towing installation is rotatable 360 degrees with respect to the tug about the central deck.

2. A tug (11) according to claim 1, wherein the upward sloping angle (a) of the towing installation (13) is between 6 to 12 degrees.

3. The tug (11) according to claim 1, wherein the forward deck (15) slopes upward with a sloping angle (p) with respect to a horizontal plane in a range of 5 to 10 degrees.

4. The tug according to claim 1, wherein the aft deck (16) slopes downward with a sloping angle (γ) with respect to a horizontal plane in a range of 4 to 8 degrees.

5. The tug (11) according to claim 1, further comprising a secondary fixed towing point (22) disposed on the aft deck (16).

6. The tug (11) according to claim 1, further comprising a plate (27) for supporting the towing installation (13).

7. The tug (11) according to claim 6, wherein a diameter or width of the plate (27) is in g range of 70% to 100% of a beam of the tug (11).

8. The tug (11) according to claim 6, wherein the plate (27) contains machined grooves along an outer edge to mount rail segments.

9. The tug (11) according to claim 6, wherein the plate (27) has a circular shape.

10. The tug (11) according to claim 6, wherein the plate (27) has an oval or elliptical shape.

11. The tug (11) according to claim 6, wherein a thickness of the plate (27) is between 80 to 100 mm.

12. The tug (11) according to claim 6, wherein thickness of the plate (27) is 200 mm.

13. The tug (11) according to claim 6, further comprising a vertical outer pipe (28) supporting the plate (27);

wherein the vertical outer pipe comprises curved surfaces.

14. The tug (11) according to claim 13, further comprising a vertical inner pipe (29);

wherein the vertical outer pipe (28) and the vertical inner pipe support the plate (27);

wherein the vertical outer pipe and the vertical inner pipe comprise curved surfaces.

15. The tug (11) according to claim 14, wherein the curved surfaces of the vertical outer pipe (28) and the vertical inner pipe (29) extend vertically in a straight line.

16. The tug (11) according to claim 13, wherein the vertical outer pipe (28) has outer edges which are at least 90% of a radius of the plate (27).

17. The tug (11) according to claim 14, further comprising an accommodation (18) disposed on top of the towing installation (13);

wherein an outer perimeter of the accommodation aligns in a vertical direction with the vertical outer pipe (28) or the vertical inner pipe (29).

18. The tug (11) according to claim 1, wherein the towing installation (13) includes a circular ring-shaped base rotatable 360 degrees with respect to the tug about the central deck (12).

19. A method of assembling the tug (11) according to claim 1, comprising:

constructing a central deck (12);

positioning a plate (27) on a building floor;

lifting the central deck and lowering the central deck upside down on a surface of the plate; and welding the plate to the central deck.

20. A tug (11) according to claim 1, wherein a rotating plane of the towing installation is parallel to the central deck.

* * * * *